US006683418B2

(12) United States Patent
Shoji et al.

(10) Patent No.: US 6,683,418 B2
(45) Date of Patent: Jan. 27, 2004

(54) INVERTER TYPE ILLUMINATION LIGHTING APPARATUS

(75) Inventors: Hiroyuki Shoji, Hitachi (JP); Hideki Miyazaki, Hitachi (JP); Kenji Kawabata, Ome (JP)

(73) Assignee: Hitachi, Ltd., Tokyo (JP)

( * ) Notice: Subject to any disclaimer, the term of this patent is extended or adjusted under 35 U.S.C. 154(b) by 67 days.

(21) Appl. No.: 09/960,406

(22) Filed: Sep. 24, 2001

(65) Prior Publication Data

US 2002/0125834 A1 Sep. 12, 2002

(30) Foreign Application Priority Data

Mar. 7, 2001 (JP) ..... 2001-062987

(51) Int. Cl.[7] ..... H05B 37/02
(52) U.S. Cl. ..... 315/224; 315/307; 315/209 R
(58) Field of Search ..... 315/224, 225, 315/244, 219, 209 R, 291, 307, 308, 247

(56) References Cited

U.S. PATENT DOCUMENTS 5,502,423 A * 3/1996 Okude et al. ..... 315/291
5,939,836 A * 8/1999 Mita et al. ..... 315/224
6,008,590 A * 12/1999 Giannopoulos et al. . 315/209 R
6,452,344 B1 * 9/2002 MacAdam et al. ..... 315/307

FOREIGN PATENT DOCUMENTS

JP 11-37641 2/1999

* cited by examiner

*Primary Examiner*—Wilson Lee
(74) *Attorney, Agent, or Firm*—Antonelli, Terry, Stout, & Kraus, LLP

(57) ABSTRACT

An illumination lighting apparatus has a resonance load circuit including a discharge tube, a power supply circuit for generating DC voltage from commercial AC voltage, and an inverter for converting the generated DC voltage into an AC voltage and supplying the AC voltage to the resonance load circuit. Further, a control circuit is provided which controls electric power supplied to the resonance load circuit in response to operating parameters of the discharge tube immediately after lighting of the discharge tube.

28 Claims, 14 Drawing Sheets

INVERTER TYPE ILLUMINATION LIGHTING APPARATUS

BACKGROUND OF THE INVENTION

The present invention relates to inverter type illumination lighting apparatus.

In an inverter type illumination apparatus, DC voltage obtained from commercial AC voltage is converted into a high-frequency AC voltage which in turn is applied to a discharge tube and in recent years, the inverter type illumination apparatus has been used widely. In this type of illumination apparatus, the discharge tube may be either a typical fluorescent lamp with filament or an electrodeless fluorescent lamp without filament operative to generate plasma by using the line of magnetic force emitted from an exciting coil. As well known, in the fluorescent lamp, mercury vapor in a discharge tube is excited to cause it to discharge ultraviolet rays which in turn are converted into visual light at a fluorescent material applied to the inner surface of the tube. A typical fluorescent lamp incorporating amalgam has main amalgam for setting the mercury vapor pressure during lighting to an optimum value and auxiliary amalgam for accelerating discharge of mercury immediately after lighting. In lighting based on the conventional copper/iron stabilizer incorporating a glow lamp, the filament is preheated while the glow lamp is in operation and the auxiliary amalgam provided to the electrode is heated to raise the mercury vapor pressure in the tube so as to improve rising of luminous flux. In the inverter type, however, instantaneous lighting is required and consequently, sufficient time for filament preheating cannot be assured, raising a problem that the mercury vapor pressure is low immediately after lighting or at low temperatures to delay rising of luminous flux.

As a conventional example of improvement in luminous flux rising in fluorescent lamps, a lighting apparatus disclosed in JP-A-11-37641 is known. In the lighting apparatus, a fluorescent lamp provided in a refrigerator is turned on/off by means of a control circuit of the lighting apparatus in accordance with open/close of a door. The control circuit is connected to a timer and the timer operable non-cooperatively with open/close of the door acts to turn on/off the fluorescent lamp at a predetermined hour or time. Through this, a phenomenon that the temperature of the fluorescent lamp continues to be low for a long time can be mitigated. In addition, overpower can be supplied to the fluorescent lamp for a predetermined time following start of lighting to accelerate mercury vaporization inside the tube to thereby improve rising of luminous flux.

SUMMARY OF THE INVENTION

In the prior art, however, when the lamp is turned on/off non-cooperatively with open/close of the door of the refrigerator, the predetermined time is set using the timer provided in the lighting apparatus. Further, even when overpower is supplied to the lamp for the predetermined time immediately after lighting, the time is set by the timer to control lighting. Disadvantageously, when the timer is provided to the lighting apparatus to perform lighting control as described above, the number of parts is increased to increase the circuit scale and raise costs.

An object of the invention is to provide an illumination lighting apparatus capable of improving the luminous flux immediately after lamp lighting or at low temperatures in a lighting apparatus for use with a discharge tube suitable for high-frequency operation.

According to one aspect of the invention, to accomplish the above object, an illumination lighting apparatus provided with an inverter for converting DC voltage generated by a power supply circuit into AC voltage to supply the AC voltage to a resonance load circuit comprises a control circuit for adjusting or regulating electric power supplied to the resonance load circuit in accordance with operating conditions of a discharge tube after initial lighting in which the discharge tube starts lighting following preheating.

DETAILED DESCRIPTION OF THE EMBODIMENTS

Figure 1:
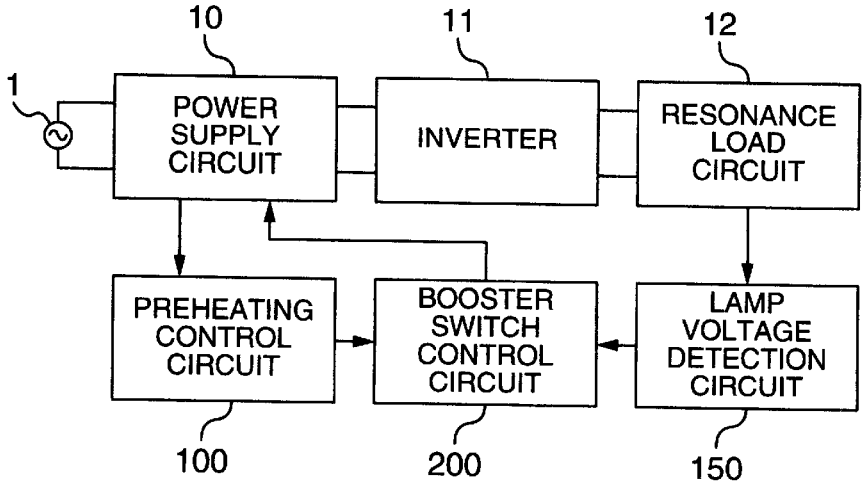
FIG. 1 is a block diagram of a lighting apparatus according to a first embodiment of the invention.
Figure 2:
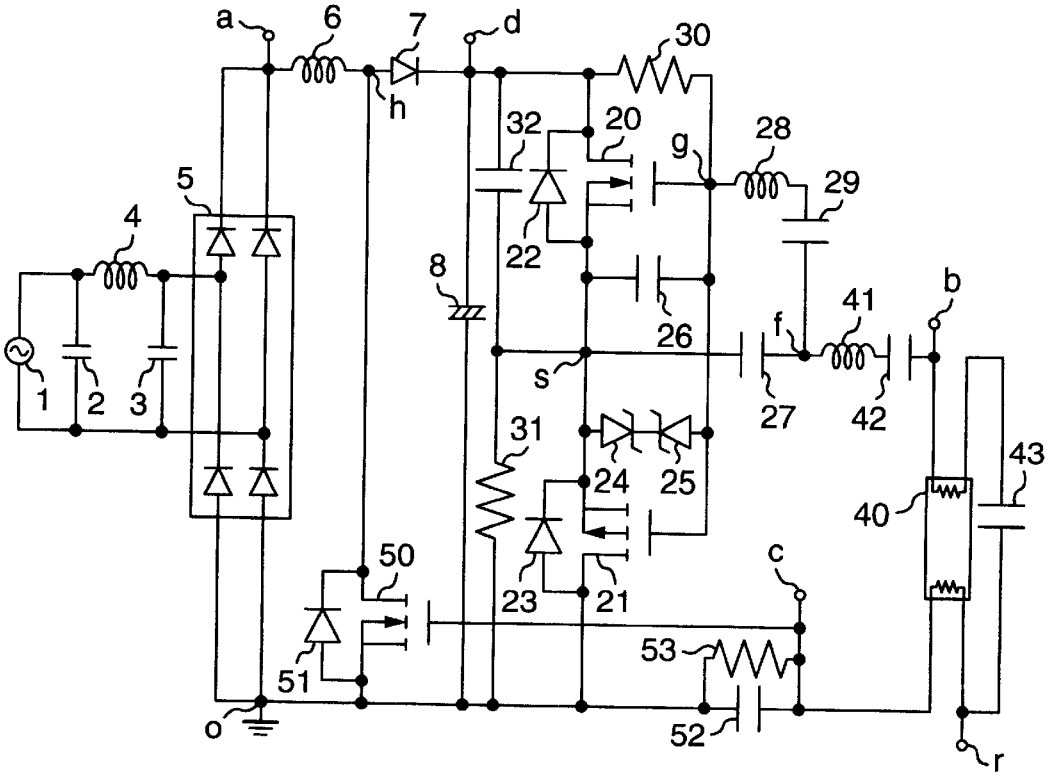
FIG. 2 is a circuit diagram showing a lighting circuit in the first embodiment.

Referring now to FIG. 1, there is illustrated, in block form, an illumination lighting apparatus according to a first embodiment of the invention. In FIG. 1, a lighting circuit includes a resonance load circuit 12 having a discharge tube, a power supply circuit 10 for generating DC voltage from commercial AC voltage 1 and an inverter 11 for converting the generated DC voltage into an AC voltage and supplying the AC voltage to the resonance load circuit 12. The lighting circuit has a circuitry as shown in FIG. 2. A description will first be given by making reference to FIG. 2.

In FIG. 2, the commercial AC voltage 1 is applied to a rectifier circuit 5 through a filter comprised of capacitors 2 and 3 and inductor 4. The AC voltage is full-wave rectified by means of the rectifier circuit 5 in the form of a diode bridge and is then applied to a booster type power supply circuit comprised of inductor 6, power semiconductor switching device 50, diode 7 and capacitor 8. With the switch 50 of the power supply circuit turned on, potential at a node h becomes equal to that at a node o and energy is stored in the inductor 6 in accordance with a potential difference between nodes a and o. During turning-off of the switch 50, the smoothing capacitor 8 is charged through the diode 7 to obtain a DC voltage. The inverter converts this voltage into high-frequency electric power which in turn is supplied to a fluorescent lamp to bring it into high-frequency lighting.

The inverter includes two power semiconductor switching devices 20 and 21 connected in the half bridge form. The switch 20 is an N-channel type power MOSFET and the switch 21 is a P-channel type power MOSFET, so that they are complementary to each other. A free-wheel diode 22 is built in the switch 20 between its source and drain terminals. Similarly, a free-wheel diode 23 is built in the switch 21 between its drain and source terminals. The individual switches 20 and 21 have their source terminals connected in common to a node s and their gate terminals connected in common to a node g. Current flowing between the drain and source of each of the switches 20 and 21 is controllable by the same voltage developing across the nodes g and s. The resonance load circuit including capacitor 27, inductor 41 for resonance, capacitor 42 for DC component elimination, fluorescent lamp 40 and capacitor 52 is connected between the node s and the negative pole o of capacitor 8, with the fluorescent lamp 40 having a resonance capacitor 43 connected in parallel through electrodes. When alternate switching operation of the switches 20 and 21 is carried out, bidirectional current flows through the resonance load circuit to turn on the fluorescent lamp. A capacitor 32 connected across the drain and source of the switch 20 adjusts a voltage change between the drain and source of each of the two switches. The capacitor 32 may otherwise be connected across the drain and source of the switch 21 to play a similar role.

Figure 3:
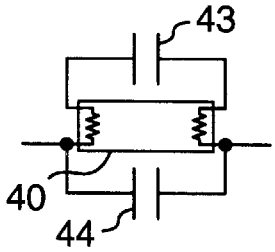
FIG. 3 is a circuit diagram showing another connection in the FIG. 2 circuit.
Figure 4:
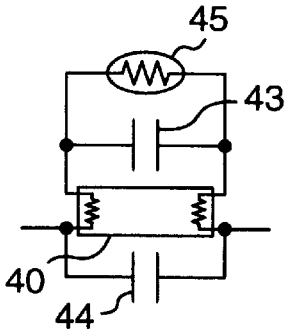
FIG. 4 is a circuit diagram showing still another connection in the FIG. 2 circuit.
Figure 5:
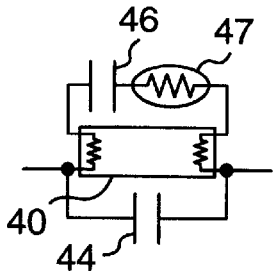
FIG. 5 is a circuit diagram showing still another connection in the FIG. 2 circuit.

In FIG. 2, the capacitor 43 is connected through the medium of the electrodes of the fluorescent lamp 40 as described above so that the electrodes may be preheated sufficiently immediately before lighting of the fluorescent lamp. As shown in FIG. 3, a capacitor 44 may also be connected in parallel to the fluorescent lamp with a view to branching current about to flow through the electrodes during lighting so as to suppress a loss at the electrodes. Alternatively, by connecting a thermistor of positive characteristic in parallel to the capacitor 43 as shown in FIG. 4, the preheating current can be controlled. The positive characteristic thermistor has such a characteristic that its resistance is small at temperatures below the Curie temperature but it rises as the temperature exceeds the Curie temperature, making it possible to control the preheating current in accordance with a change in resistance. In order to minimize the current flowing through the electrodes during lighting as far as possible and suppress the loss at the electrodes, a series connection of capacitor 46 and positive characteristic thermistor 47 is connected through the electrodes of the fluorescent lamp 40, as shown in FIG. 5.

A gate drive circuit for controlling the conduction state of the switches 20 and 21 includes the capacitor 27 connected on the resonance load circuit. For the sake of operating the gate drive circuit, the capacitor 27 acquires a drive voltage from the current flowing through the resonance load circuit. The capacitor 27 has one end connected to a node f and inductor 28 and capacitor 29 are connected between the nodes g and f. The inductor 28 gives a phase difference to the voltage across the gate and source with respect to the current flowing through the resonance load circuit and takes part in setting of the operating frequency. The capacitor 29 fills the role of eliminating a DC component superimposed on AC voltage applied across the gate and source. Zener diodes connected in series are connected across the gate and source in parallel therewith. These diodes act to prevent breakage of the switching devices in the event that an excessive voltage is applied across the gate and source of the respective switches 20 and 21. In some types of MOSFET's, Zener diodes for prevention of excessive gate voltage have already been built in these MOSFET's and when switching devices of this type are chosen, the aforementioned Zener diodes can be removed. Further, a capacitor 26 is connected across the gate and source for the purpose of adjusting a change in voltage across the gate and source. More specifically, the capacitor 26 fills the role of compensating a dead time starting with turning-off of one switch and ending in turning-on of the other switch during alternate switching operation of the switches 20 and 21.

Next, start operation of the inverter will be described. When the AC voltage 1 is applied and voltage across the capacitor 8, that is, DC voltage developing at a node d relative to the node o increases, current flows through a path of resistor 30, inductor 28, capacitors 29 and 27 and resistor 31, with the result that voltage developing at the node g relative to the node s, that is, voltage across the gate and source gradually increases. As the voltage across the gate and source goes beyond a gate threshold voltage of the switch 20 to turn on the switch 20, current flows from the node d toward the node f through a path of the switch 20 and capacitor 27 and voltage at the node f decreases. Consequently, the voltage across the gate and source immediately falls below the threshold voltage of the switch 20, thus turning off the switch 20. Since the capacitor 27 connected between the nodes f and s as well as the capacitor 26 and inductor 28 form an LC resonance circuit, a slight change in voltage across the capacitor 27 causes the current flowing through the drive circuit to increase and the amplitude of the voltage across the gate source increases. An oscillation phenomenon as above accounts for the fact that the switches 20 and 21 alternately start switching operation.

The conduction state of the switch 50 is controlled by voltage across the capacitor 52 connected on the resonance load circuit. AC voltage is generated across the capacitor 52 in synchronism with the current flowing through the resonance load circuit and this voltage is applied to a control terminal of the switch 50 to turn it on/off. A resistor 53 connected in parallel with the capacitor 52 acts to prevent DC voltage from being superimposed on the capacitor 52.

Figure 6A:
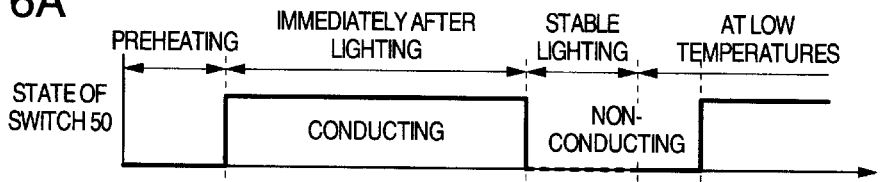
FIGS. 6A to 6C are diagrams for explaining timings of drive control in the first embodiment.
Figure 6B:
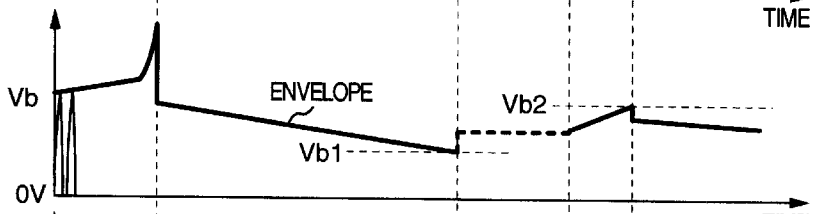
Figure 6C:
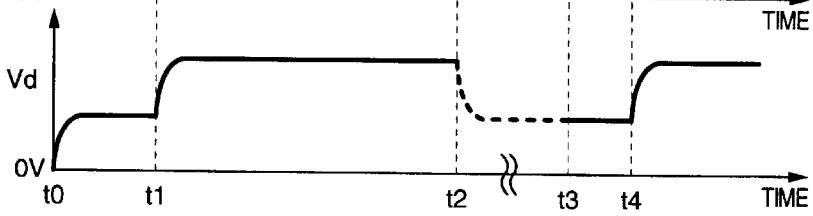
Figure 7:
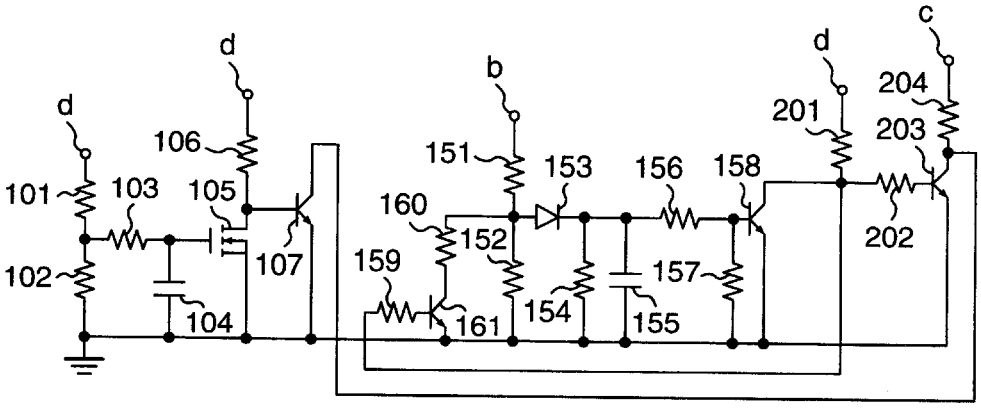
FIG. 7 is a circuit diagram showing the construction of a controller in the first embodiment.

Next, operation of the first embodiment of the invention will be described. As described previously, the mercury vapor pressure in the fluorescent lamp is low immediately after lighting or at low temperatures and rising of luminous flux is delayed. At that time, the equivalent resistance of the lamp is high and voltage across the lamp becomes high. In the embodiment of FIG. 1, the luminous flux can be improved by detecting the lamp voltage having relation to operating conditions of the lamp (the lamp voltage and current will be referred to as operating parameters) and increasing the power supply voltage of the inverter by means of the booster type power supply circuit to increase electric power supplied to the lamp when the detected voltage is high. Referring to FIGS. 6A to 6C, timing charts are illustrated which show operation flow between the start of preheating of the lamp and the lighting and ensuing interval. FIGS. 6A to 6C show the conduction state of the switch 50, detection voltage Vb at a node b and voltage Vd at the node d, respectively. The voltage at the node b changes positively and negatively at a high frequency and in FIG. 6B, an envelop of only positive voltage is illustrated. Preheating control circuit 100, lamp voltage detection circuit 150 and booster switch control circuit 200 shown in FIG. 1 control the booster switch 50 shown in FIG. 2 to ensure that the output voltage of the power supply circuit can be controlled during an interval between preheating and lighting. Turning to FIG. 7, there is illustrated the control circuit for the booster switch 50.

When the AC voltage 1 is applied at time t0 shown in FIGS. 6A to 6C, the switch 50 is rendered to be nonconducting by means of the preheating control circuit 100 during a period of from t0 to t1 (preheating process in lighting preliminary phase) and boosting operation is stopped. This is effective to preheat the electrodes of the lamp during this period so as to prevent the power supply voltage of the inverter from being boosted and to prevent the lamp from being applied with a high voltage before the electrodes are preheated sufficiently. For example, the preheating control circuit 100 can be constructed of elements 101 to 107 as shown in FIG. 7. In FIG. 7, with the AC voltage 1 applied, voltage at the node d increases. The resistors 101 and 102 divide the voltage at the node d and control voltage for switch 105 is raised by a voltage across the resistor 102 with a time constant determined by the resistor 103 and capacitor 104. The switch 105 keeps turned off until its threshold is exceeded, so that a current flows from the node d to the control terminal of the switch 107 through the resistor 106 to turn on the switch 107. The switch 107 is connected to a node c of FIG. 2 through a resistor 204 of the booster switch control circuit 200. The node c is a control terminal for the booster switch 50 and with the switch 107 turned on, the control terminal is short-circuited to the reference terminal, thereby rendering the switch 50 nonconducting. As the control voltage for the switch 105 exceeds the threshold to turn on the switch 105, the switch 107 is turned off to make the booster switch 50 ready for conduction.

At the time that the lamp is lit at time t1 in FIGS. 6A to 6C, the switch 50 is rendered to be conducting to keep its conduction so as to perform boosting operation until detection voltage Vb of the lamp voltage detection circuit 150 falls below Vb1.

During initial lighting between times t1 and t2, a lighting initial process proceeds in which the discharge tube such as fluorescent lamp starts lighting. The lighting initial process intervenes between the preheating process and a steady lighting process for performing stable and steady lighting and provides darker lighting than steady lighting.

The lamp voltage detection circuit 150 can be constructed of elements 151 to 161 as shown in FIG. 7. In FIG. 7, the resistors 151 and 152 divide the lamp voltage at the node b. A voltage developing across the resistor 152 is rectified by the diode 153 and is then converted into a DC voltage by means of the resistor 154 and capacitor 155. A control current determined by the resistors 156 and 157 flows to the control terminal of the switch 158 to switch it on or off. With the switch 158 turned on, that is, with the detection voltage Vb being in excess of Vb1, a switch 203 of the booster switch control circuit 200 is turned off and the AC voltage developing across the capacitor 52 is applied to the control terminal of the booster switch 50, causing it to be turned on and off repetitively. During this interval, power supply voltage Vd of the inverter is boosted and high power is supplied to the lamp. As the lamp voltage gradually decreases to enhance luminous flux, Vb falls below Vb1 and the switch 158 of lamp voltage detection circuit 150 is turned off. Then, a control current flows from the node d to the switch 203 of booster switch control circuit 200 through resistors 201 and 202 to thereby turn on the switch 203. With the switch 203 turned on, the control terminal of the switch 50 is short-circuited to the reference terminal, thus rendering the switch 50 nonconducting. Also, with the switch 158 of the lamp voltage detection circuit 150 turned off, a control current flows from the node d to the control terminal of the switch 161 through the resistors 201 and 159 to thereby turn on the switch 161. This brings the resistor 152 for voltage division into parallel connection with the resistor 160, with the result that the voltage across resistor 152 obtained by dividing the voltage at the node b further decreases to avoid immediate turning-on of the switch 158. As a result, the switch 50 is rendered nonconducting to lose the boosting function to thereby decrease the inverter voltage Vd at time t2 in FIG. 6. This prevents the lamp voltage from rising again and the operation from shifting to the boosting operation. During an interval between t2 and t3 for stable luminous flux of the lamp (steady lighting process for performing stable and steady lighting), the inverter voltage Vd is set to a low level to lower the voltage applied to the switches 20 and 21 of the inverter and therefore, load imposed on these devices can be mitigated. The working environment of the lamp changes at time t3 in FIGS. 6A to 6C to take a low temperature state, the luminous flux decreases and the lamp voltage increases to raise the voltage Vb. As the voltage Vb exceeds Vb2 at time t4, the voltage developing across the the resultant resistance of resistors 152 and 160 of lamp voltage detection circuit 150 increases to turn on the switch 158. Thus, the switch 203 of booster switch control circuit 200 is turned off, causing the booster switch 50 to perform boosting operation and as the power supply voltage Vd of the inverter increases, high electric power is supplied to the lamp. While the switch 158 being turned on, the switch 161 is turned off and as a result, the resistor 160 connected in parallel with the resistor 152 is disconnected. Accordingly, the voltage developing across the resistor 152 further increases and it is avoidable for the switch 158 to be turned off immediately. Thus, the switch 50 keeps conducting to fulfill the boosting function, thereby ensuring that the inverter voltage Vd is increased and the lamp voltage is again decreased to prevent the boosting operation from stopping. In the foregoing, the lamp voltage is detected for controlling the booster switch 50 but another method for control of the booster switch 50 may be employed in which the state of the lamp is detected by voltage or current of the filament (an operating parameter relating to operating conditions of the discharge tube such as fluorescent lamp). In that case, by detecting voltage at a node r in FIG. 2, a filament voltage can be detected. Otherwise, a filament current can be detected easily by connecting a current transformer in series with the capacitor 43 as shown in FIG. 2. As described above, immediately after lighting or at low temperatures, the lamp current decreases and consequently, current flowing to the filament increases to raise filament voltage. Accordingly, the filament voltage changes similarly to the lamp voltage and hence reduction in luminous flux immediately after lighting or at low temperatures can be suppressed by carrying out the control operation as above.

Figure 8:
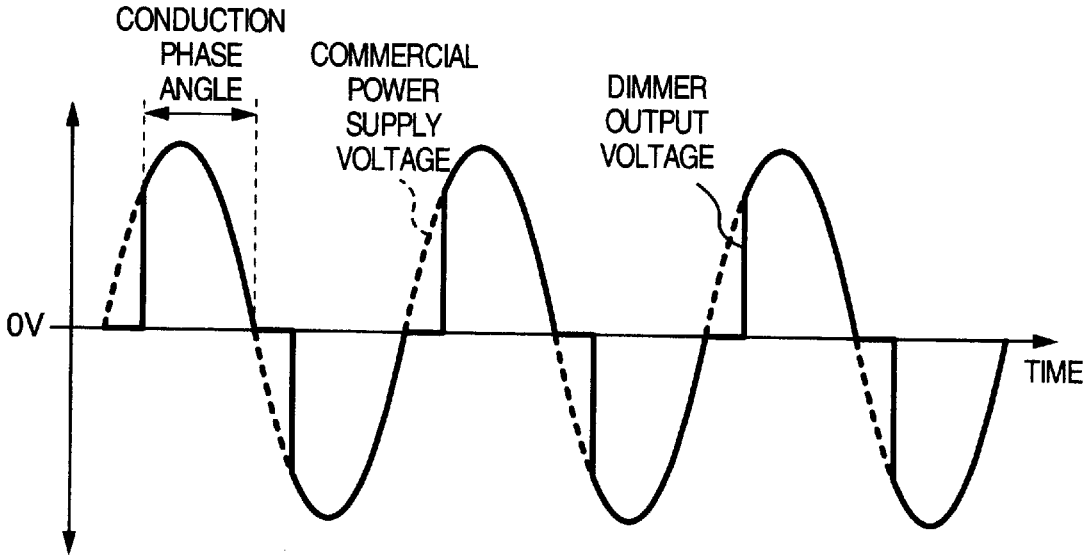
FIG. 8 is a diagram showing a voltage waveform of commercial AC power supply and an output voltage waveform of a dimmer.
Figure 9:
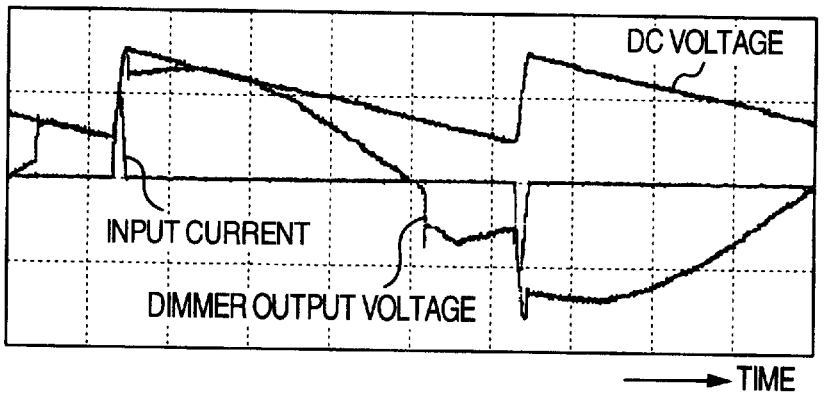
FIG. 9 is a diagram showing an output voltage when a capacitive load is connected to the dimmer, an input current and a DC voltage waveform after smoothing.
Figure 10:
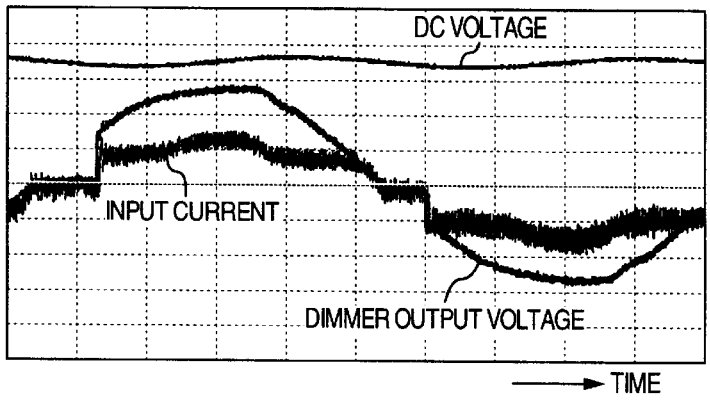
FIG. 10 is a diagram showing an output voltage when a resistive load is connected to the dimmer, an input current and a DC voltage waveform after smoothing.
Figure 11:
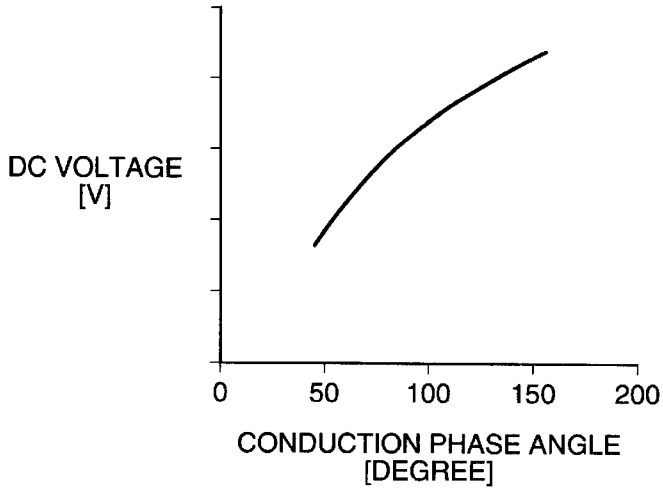
FIG. 11 is a graph showing the relation between the conduction phase angle of AC power supply voltage and the DC voltage in the first embodiment.
Figure 12:
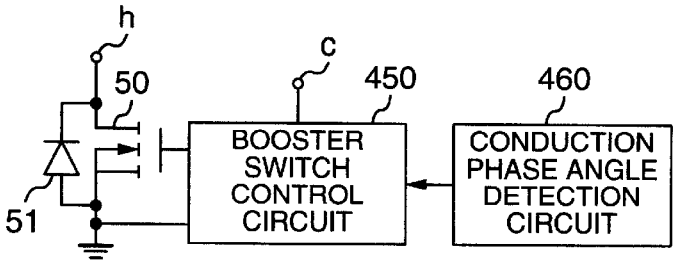
FIG. 12 is a block diagram showing another construction of the controller in the first embodiment.
Figure 13:
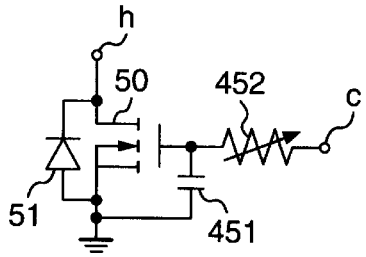
FIG. 13 is a circuit diagram of the construction of the FIG. 12 controller.

When the switch 50 is in conducting condition in the FIG. 2 circuit, the power supply circuit absorbs current from the AC voltage 1 in accordance with the high-frequency operation of the inverter, thus permitting current to flow during the total period of the AC voltage 1. Accordingly, the input current having passed through the filter is substantially in phase with the AC voltage and the power factor can be improved. In the foregoing, only immediately after lighting or at low temperatures, the boosting operation is carried out to adjust or regulate the supply of power to the lamp but by performing the boosting operation at a reduced boosting ratio also during the period in which the luminous flux is stable, the input current can also be allowed to always flow during the total period of the AC voltage. In case the input current is passed continuously without a pause as described above, the power supply circuit can be connected to a dimmer for use with incandescent lamps. Generally, the dimmer is loaded with a resistor such as an electric lamp and electric power to the load is controlled through control of the conduction phase angle of commercial power supply voltage as shown in FIG. 8. Graphically shown in FIG. 9 are waveforms of output voltage, input current and DC voltage after smoothing in the dimmer when a capacitive load such as a capacitor smoothing circuit is connected to the dimmer. As shown, the input current pauses and the output of the dimmer is not controlled for phase angle. In FIG. 10, on the other hand, the input current flows over the total period of AC voltage and the output voltage of the dimmer has a waveform that is controlled for phase angle. Since the input current changes with the output of the dimmer in this manner, the relation between DC voltage and conduction phase angle becomes substantial proportional as shown in FIG. 11. Accordingly, by taking advantage of the change in DC voltage, brightness of the lamp can be changed in accordance with the conduction phase angle. The on-duty of the switch 50 is determined by the voltage amplitude of the capacitor 52 but the booster switch 50 may be connected with a control circuit 450 as shown in FIG. 12 so that the on-duty may be changed by a command value from a conduction phase angle detection circuit 460. With this construction, the changing of DC voltage with the conduction phase angle can be adjusted arbitrarily to permit the DC voltage to be changed more accurately. In this case, the booster switch control circuit 450 can be implemented by, for example, an RC circuit including a resistor 452 and a capacitor 451 as shown in FIG. 13. The conduction phase angle detection circuit 460 can detect a conduction phase angle easily by, for example, detecting a voltage at the node a in FIG. 2 and the on-duty of the switch 50 can be changed by changing the resistance of the resistor 452 in accordance with a detection value. The conduction phase angle detection circuit can be constructed in a different way as will be described later. As described previously, the drive circuit of switch 50 is of the self-excited type in which the current in the resonance load circuit is fed back to generate a drive voltage but a drive circuit of the separately-excited type may also be used to control the on-duty in accordance with the conduction phase angle and an input signal from the user.

Electric power supplied to the lamp is adjusted by utilizing the boosting function in the foregoing but in the case of the current resonance type inverter as in the present embodiment, the load on the inverter becomes inductive when operating frequency fs representing the drive frequency is set to be higher than resonance frequency fr and by lowering the operating frequency fs to cause it to approximate the resonance frequency fr, the electric power supplied to the lamp can be increased. Next, a method of adjusting lamp power by changing the operating frequency will be described.

Figure 14:
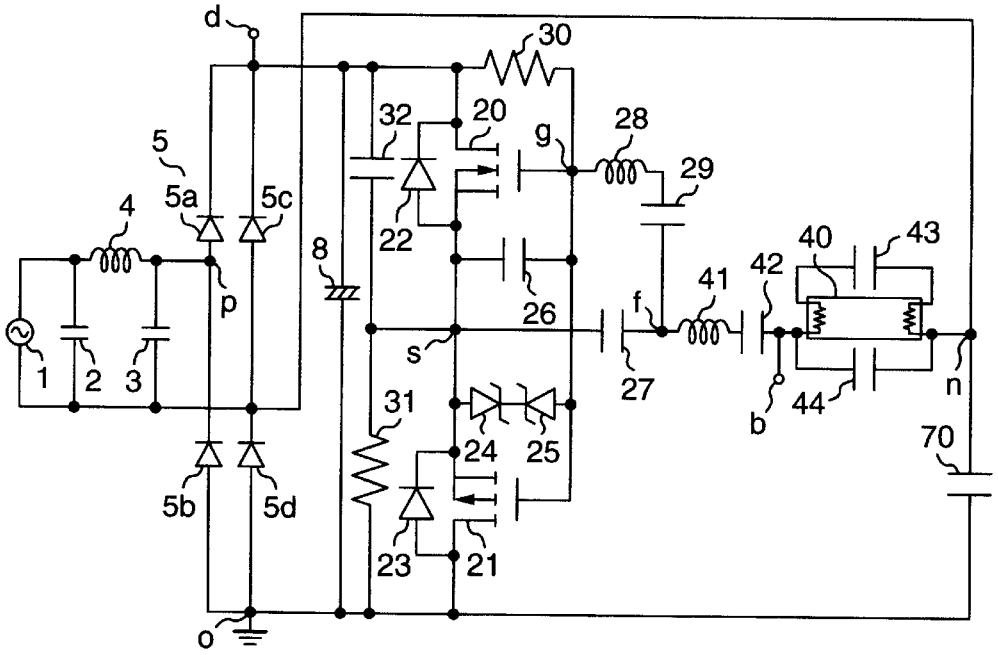
FIG. 14 is a circuit diagram of a lighting circuit according to a second embodiment of the invention.
Figure 15:
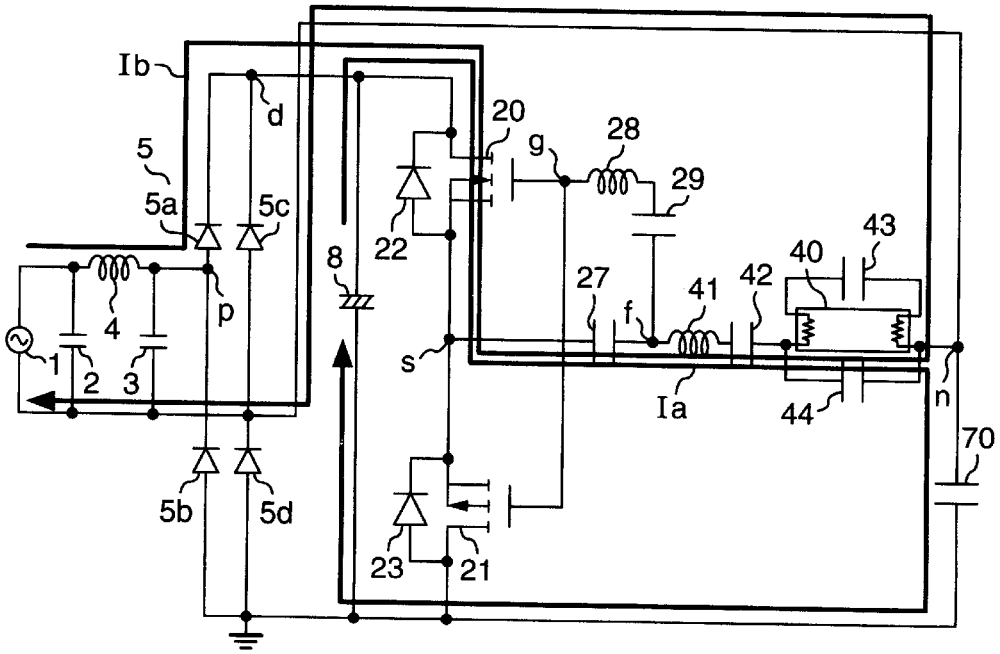
FIG. 15 is a circuit diagram useful to explain the operation of the FIG. 14 embodiment.
Figure 16:
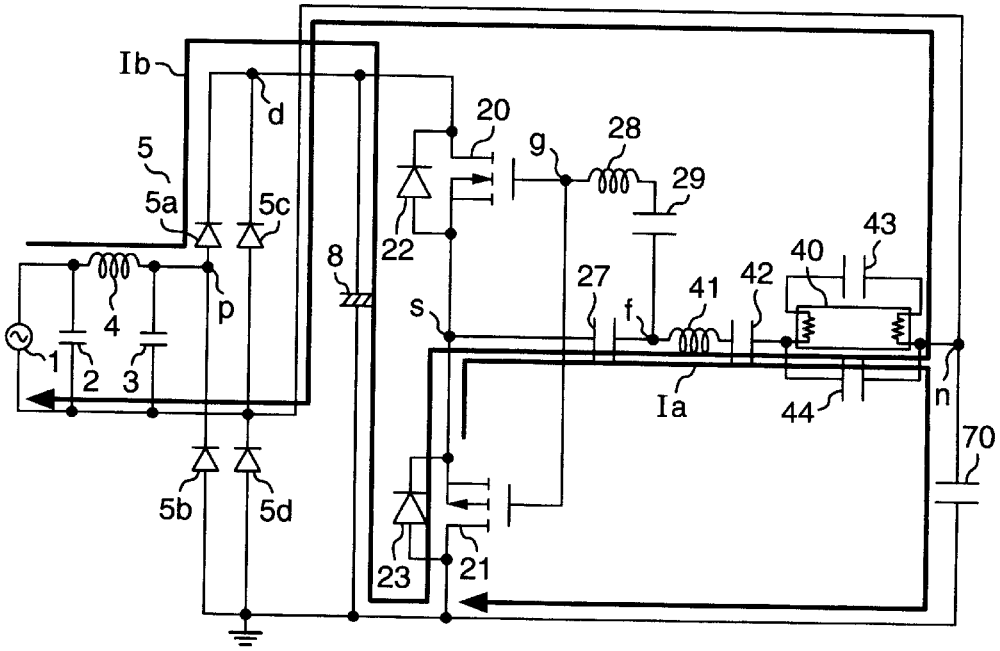
FIG. 16 is a circuit diagram useful to explain the operation of the FIG. 14 embodiment.
Figure 17:
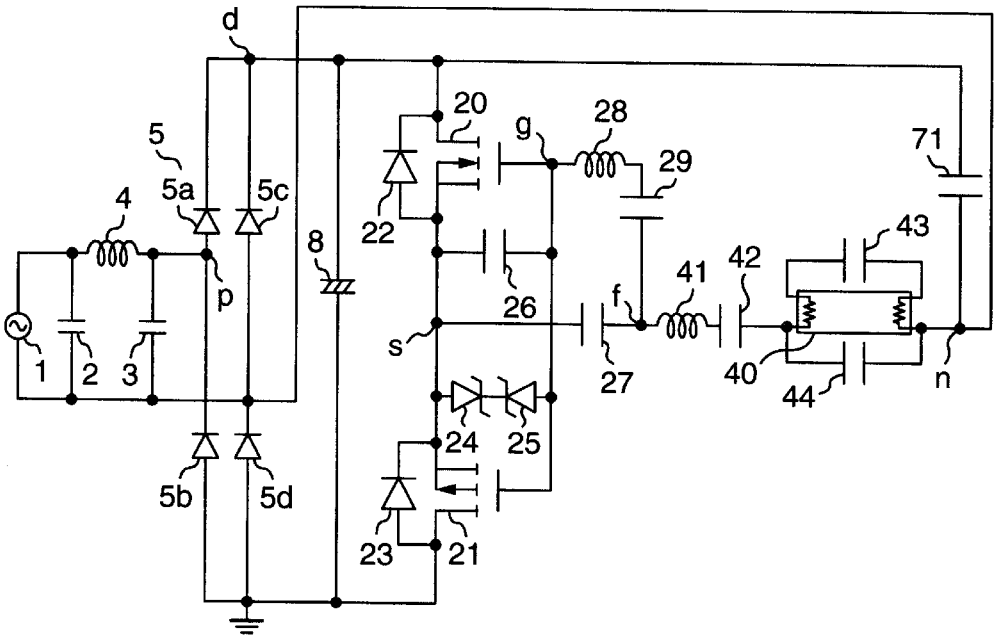
FIG. 17 is a circuit diagram of a lighting circuit according to a third embodiment of the invention.
Figure 18:
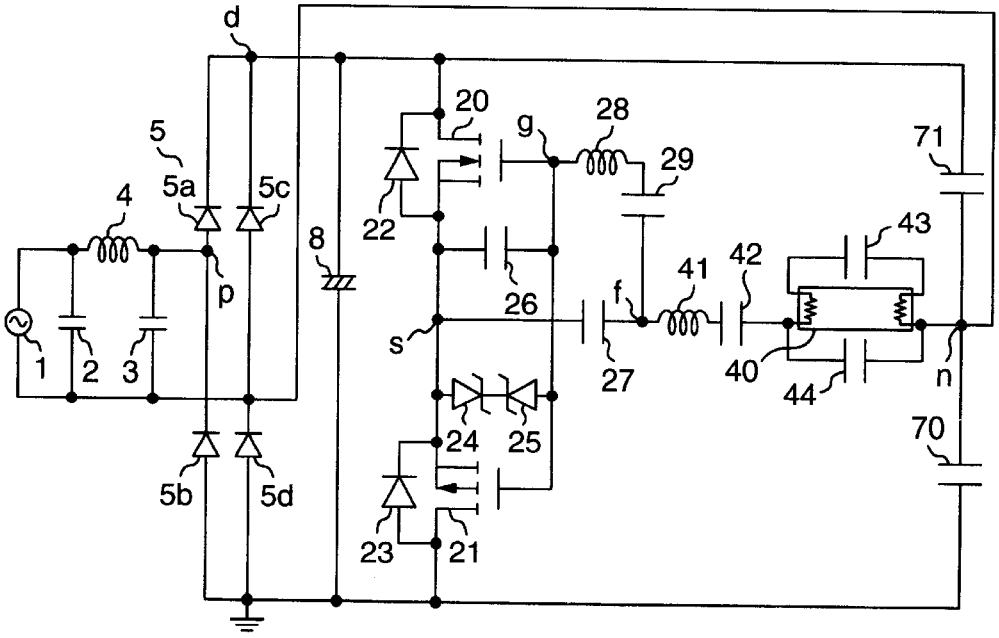
FIG. 18 is a circuit diagram of a lighting circuit according to a fourth embodiment of the invention.

Referring to FIG. 14, there is illustrated a circuit diagram showing a lighting circuit according to a second embodiment of the invention. In FIG. 14, constituent components identical to those in FIG. 2 are designated by identical reference numerals and will not be described. In the present embodiment, by utilizing voltage of a capacitor 70 provided in the resonance load circuit imposed on the inverter, input current can be passed over the total period of AC voltage 1 and the lamp power can be adjusted by using a dimmer for incandescent lamps. Operation of the FIG. 14 circuit will first be described and a method of changing the operating frequency will be described later. In FIG. 14, a resonance load circuit including capacitor 27, inductor 41 for resonance, capacitor 42 for elimination of DC components, fluorescent lamp 40 and capacitor 70 is connected between node s and negative pole point o of capacitor 8. The fluorescent lamp 40 has a capacitor 44 connected in parallel and a capacitor 43 connected through electrodes. The capacitor 70 is connected in parallel to a diode Sd of the rectifier circuit 5. Next, operation of the FIG. 14 circuit will be described with reference to FIGS. 15 and 16. In operation to be described herein, current flows in from AC voltage 1. In FIG. 15, when the switch 20 is turned on, current IA flows from the capacitor 8 through a path of the switch 20, capacitor 27, inductor 41, capacitor 42, lamp 40 and capacitor 70. The current IA charges the capacitor 70 and voltage Vn at a node n of the cathode terminal of diode 5*d* and the capacitor 70 increases. Where the anode terminal of a rectifier diode 5*a* is connected to a node p and voltage at node p referenced to the point o is Vp, the voltage Vp equals the sum of Vn and AC voltage 1. As the voltage Vn increases to cause the voltage Vp to exceed voltage Vd at the node d, the diode 5*a* of the rectifier circuit 5 is rendered to be conducting. With the diode 5*a* turned on, current Ib flows from the AC voltage 1 through a path of inductor 4, diode 5*a*, switch 20, capacitor 27, inductor 41, capacitor 42 and lamp 40. As a result, two of current IA flowing out of the capacitor 8 and current Ib, which are superimposed on each other, flow to the resonance load circuit inclusive of the lamp 40. When the switch 20 is turned off, current IA circulates through a path of inductor 41, capacitor 42, lamp 40, capacitor 70 and diode 23 as shown in FIG. 16. On the other hand, current Ib charges the capacitor 8 through a path of inductor 4, diode 5*a*, capacitor 8, diode 23, capacitor 27, inductor 41, capacitor 42 and lamp 40. During this interval of time, the switch 21 is turned on and the current IA continues to flow until energy stored in the inductor 41 is dissipated. In the succeeding operation mode, though not illustrated, the polarity of the current IA is inverted by a voltage developing across the capacitor 70 and then, the current IA flows through a path of capacitor 70, lamp 40, capacitor 42, inductor 41, capacitor 27 and switch 21. When the voltage Vn at the node n, that is, the voltage across the capacitor 70 gradually decreases to render the diode 5*d* of the rectifier circuit 5 conductive, a current flows through a path of inductor 41, capacitor 27, switch 21, diode 5*d*, lamp 40 and capacitor 42. At the time that the switch 21 is turned off, energy stored in the inductor 41 causes a current to circulate through a path of inductor 41, capacitor 27, diode 22, capacitor 8, diode 5*d*, lamp 40 and capacitor 42. During this interval of time, the switch 20 is turned on and the current continues to flow until energy stored in the inductor 41 is dissipated. As described above, by taking advantage of the change of voltage across the capacitor 70 to turn on/off the rectifier diodes at a high frequency, the input current can be passed over the total period of AC voltage 1 with a minimal number of additional parts. In FIG. 14, the capacitor 70 is connected in parallel with the diode 5*d* of rectifier circuit 5 but even when the capacitor 70 is connected in parallel with the diode 5*b*, the input current can be passed over the total period of the AC voltage 1 as in the precedence. Further, as in a lighting circuit according to a third embodiment of the invention shown in FIG. 17, a resonance load circuit including a capacitor 71 connected between the node n and the positive pole point d of the capacitor 8 may be connected. In this embodiment, the capacitor 71 is connected in parallel with a diode 5*c* of the rectifier circuit 5 and current is absorbed from the AC voltage 1 by taking advantage of the change of voltage across the capacitor 71. Moreover, as in a lighting circuit according to a fourth embodiment of the invention shown in FIG. 18, capacitors 70 and 71 may be connected in parallel with the diodes 5*d* and 5*c*, respectively, of the rectifier circuit 5 to ensure that the input current is passed over the total period of the AC voltage 1 as in the precedence. In the embodiment of FIGS. 14, 17 and 18, a high-frequency current at the same frequency as that of the inverter flows in the diodes of the rectifier circuit and therefore, high-speed diodes are preferably used as these diodes.

Figure 19:
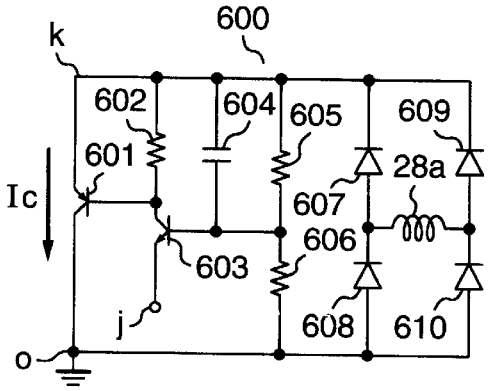
FIG. 19 is a circuit diagram of a shunt current adjuster circuit in the FIG. 14 embodiment.
Figure 20:
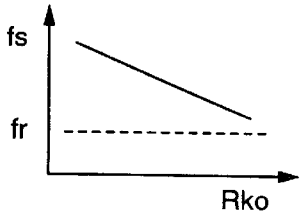
FIG. 20 is a graph showing the relation between operating resistor of a shunt current adjuster circuit in the FIG. 19 and driving frequency.

Next, a control method will be described in which the lamp state is detected immediately after lighting or at low temperatures and the operating frequency of the inverter is caused to approximate the resonance frequency so as to increase electric power supplied to the lamp. As described above, the inductor 28 included in the gate drive circuit greatly contributes to the operating frequency of the inverter and the operating frequency is high for a small inductance and is low for a large inductance. Accordingly, if the inductance of the inductor 28 can be changed arbitrarily, then the operating frequency can be adjusted. Means for changing the inductance of inductor 28 can be implemented using a shunt current adjuster circuit 600 as shown in FIG. 19 in which an inductor 28*a* coupled inductively to the inductor 28 and current flowing through the inductor 28*a* is controlled. In FIG. 19, current in the inductor 28*a* flows to a transistor 601 through diodes 607 and 610 or diodes 608 and 609. The diodes 607 and 609 are connected to the transistor 601 through a node k. Current Ic flowing through the transistor 601 can be controlled by changing the base current. Accordingly, voltage Vj at a point j is made to be variable and the current Ic is adjusted on the basis of current flowing through resistor 602 and transistor 603. Bias voltage of the transistor 603 is set by resistors 605 and 606 and voltage Vj so as to set current flowing through the transistor 603. Where the resistance between the nodes k and o, that is, the operating resistance of transistor 601 is Rko, the resistance Rko is related to the operating frequency fs as shown in FIG. 20, indicating that the smaller the resistance Rko, the operating frequency fs becomes higher and the larger the Rko, the fs becomes lower. To explain, given that the drive circuit of the inverter is considered as the primary side and the shunt current adjuster circuit 600 is considered as the secondary side, as the current Ic increases with a decrease in, for example, resistance Rko, the inductance as viewed from the primary side is decreased to raise the operating frequency. As described previously, the resistance Rko can be adjusted by the voltage Vj and hence, by changing the voltage Vj in accordance with the state of the lamp, the operating frequency fs can be changed.

Figure 21:
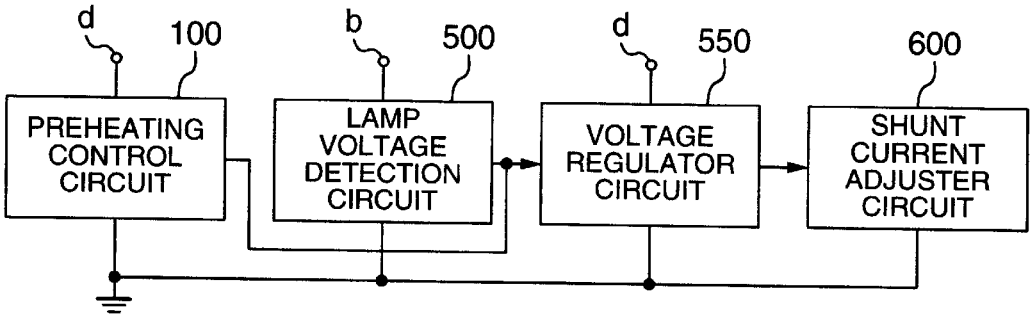
FIG. 21 is a block diagram showing the construction of a controller in the FIG. 14 embodiment.
Figure 22:
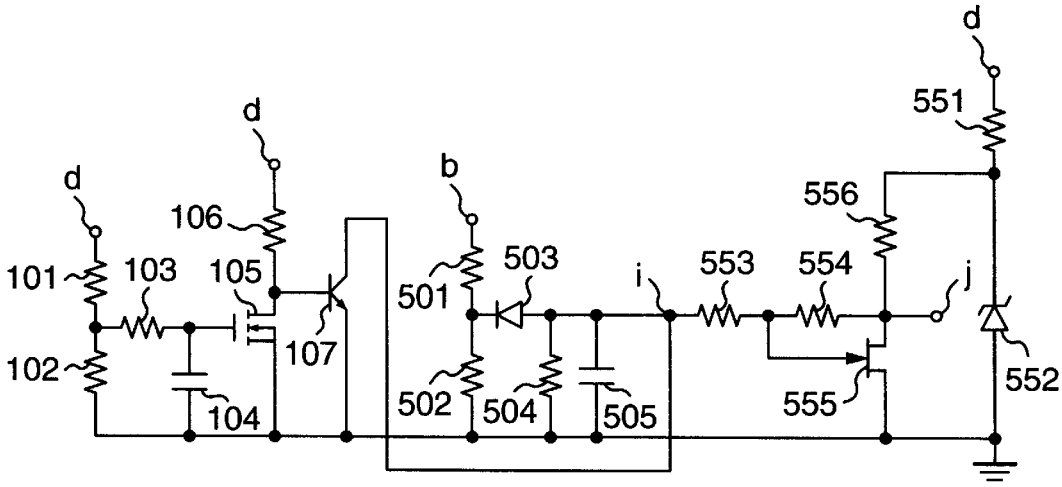
FIG. 22 is a circuit diagram showing the construction of the FIG. 21 controller.
Figure 23:
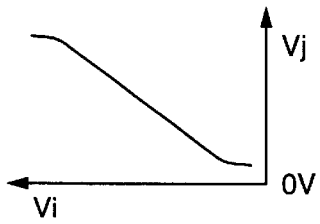
FIG. 23 is a graph for explaining the operation in the FIG. 22 controller.
Figure 24:
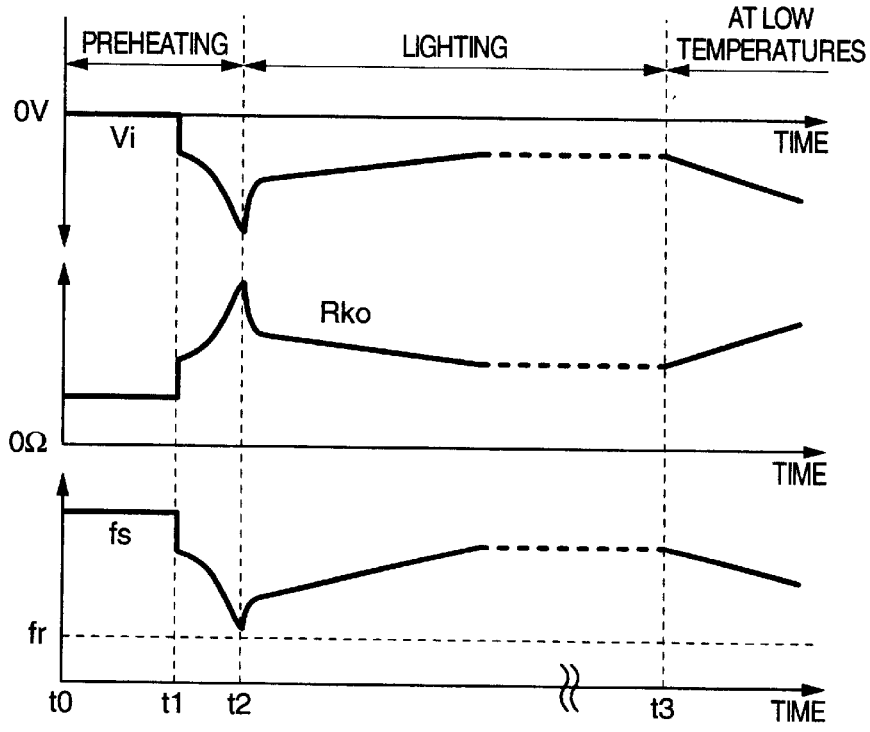
FIG. 24 is a diagram for explaining timings of driving control in the FIG. 14 embodiment.

A method of changing the voltage Vj will be described with reference to FIGS. 21 and 22. A circuit adapted to control the shunt current adjuster circuit 600 is shown, in block form and circuit diagram form, in FIGS. 21 and 22, including the preheating control circuit 100, a lamp voltage detection circuit 500 and a voltage regulator circuit 550. The preheating circuit 100 has already been described in connection with FIGS. 1 and 7 and will not be described herein. The-lamp voltage detection circuit 500 can be constructed of elements 501 to 505 as shown in FIG. 22. The voltage detection circuit 500 divides voltage at the point b in FIG. 14 by means of the resistors 501 and 502. The divided voltage is rectified by the diode 503 and thereafter converted into a DC voltage by the resistor 504 and capacitor 505. The diode 503 has its cathode connected to a node of the resistors 501 and 502 and is operative to charge the capacitor 505 when the divided voltage is negative. Accordingly, voltage Vi at a node i of the anode terminal of diode 503 and the capacitor 505 becomes negative. The voltage adjuster circuit 505 utilizes a field effect transistor as variable resistor to deliver a variable voltage to the shunt current adjuster circuit 600. As shown in FIG. 22, the voltage regulator circuit 550 includes elements 551 to 556. By changing gate voltage of the field effect transistor 555 through the resistor 553, output voltage at a node i can be adjusted. The output voltage has a value obtained by dividing Zener voltage across the Zener diode 552 by the resistor 556 and an operating resistance of the transistor 555. Current is supplied to the Zener diode 552 from the node d of FIG. 14 through the resistor 551. The relation between voltage Vi at the node i and voltage Vj at the node i is shown in FIG. 23. Referring to FIG. 23, in case the transistor 555 is a junction type n-channel field effect transistor, when the gate voltage Vi is low, the operating resistor increases and so the output voltage Vj increases. FIG. 24 is a timing chart showing flow of operation starting with the initiation of lamp preheating and ending in the lamp lighting and ensuing period. In FIG. 24, when AC voltage 1 is applied at time t0, the switch 107 is rendered to be conducting by means of the preheating circuit 100 of FIG. 22 during an interval of from t0 to t1 to bring the nodes i into the same potential of OV as that at the node o, thus causing the output voltage Vj of the voltage regulator circuit 550 to be set to a low level. Accordingly, the shunt current circuit 600 has a small resistance Rko to drive the inverter at the operating frequency fs that is sufficiently higher than the resonance frequency fr. Since the operating frequency is high during the preheating period, it is possible to prevent the lamp from being applied with a high voltage before the electrodes are preheated. As the switch 107 is turned off at time t1, the voltage Vi is set by a detection value of the lamp voltage detection circuit 500, the Vi decreases as the lamp voltage rises to increase the resistance Rko, causing the operating frequency fs to approximate the resonance frequency fr, and a high voltage is applied to the lamp at time t2. Before the luminous flux of the lamp stabilizes, the lamp voltage keeps high and the operating frequency fs assumes a frequency approximating the resonance frequency fr to thereby increase electric power supplied to the lamp. Thereafter, the luminous flux of the lamp stabilizes, followed by a decrease in the lamp voltage, and the operating frequency becomes higher. At time t3, the working environment of the lamp changes and a low temperature state is set up to raise the lamp voltage, with the result that the operating frequency fs again approximates the resonance frequency fr and a decreased in luminous flux can be suppressed. In the foregoing, the lamp voltage is detected and the operating frequency of the inverter is controlled but alternatively, a method may be employed in which the stated of the lamp is detected using filament voltage to control the operating frequency.

Figure 25:
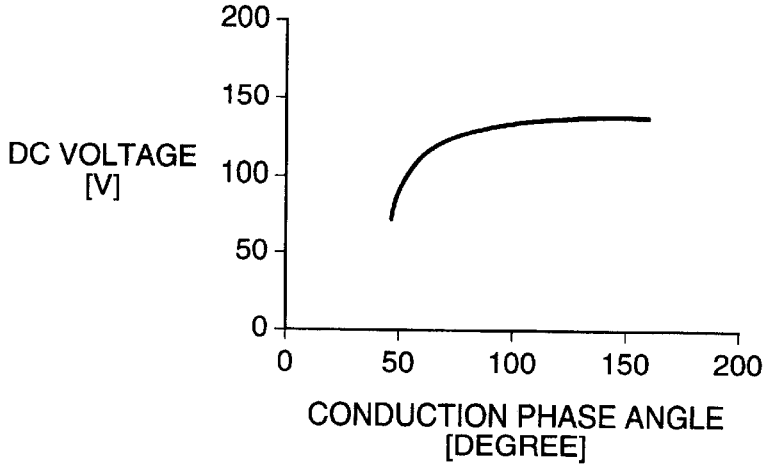
FIG. 25 is a graph showing the relation between the conduction phase angle of AC power supply voltage and DC voltage in the FIG. 14 embodiment.
Figure 26:
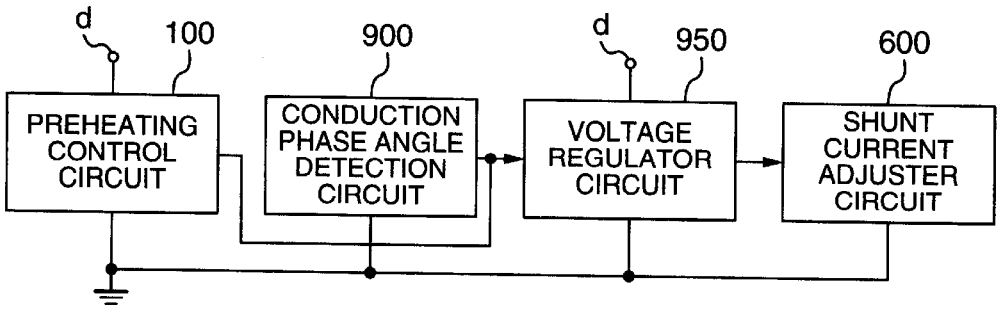
FIG. 26 is a block diagram showing another construction of the controller in the FIG. 14 embodiment.
Figure 27:
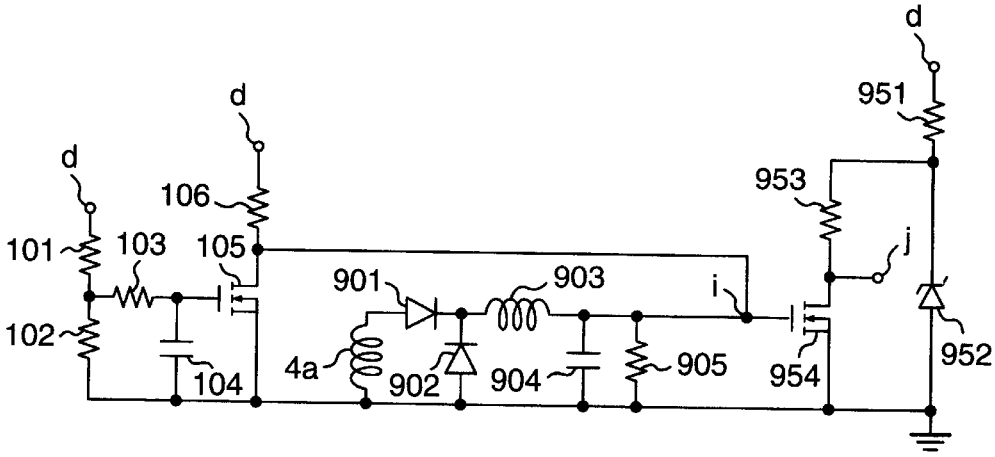
FIG. 27 is a circuit diagram showing the construction of the FIG. 26 controller.
Figure 28A:
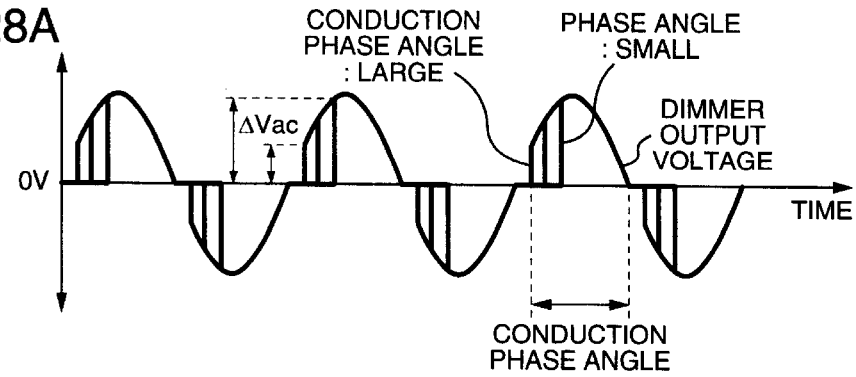
FIGS. 28A and 28B are diagrams useful to explain the operation in the FIG. 27 controller.
Figure 28B:
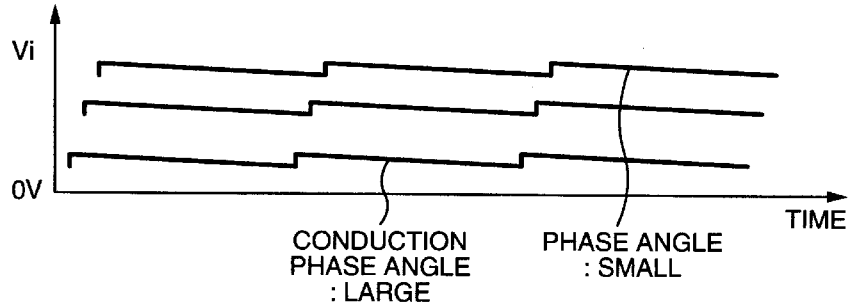
Figure 29:
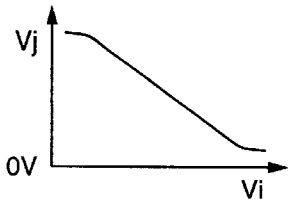
FIG. 29 is a graph for explaining the operation in the FIG. 27 controller.

When in the present embodiment the lamp power is adjusted using the dimmer, the conduction phase angle is related to the DC voltage at the node d as shown in FIG. 25. As will be seen from the figure, the DC voltage decreases as the conduction phase angle decreases from about 90° to decrease the lamp power and consequently the luminous flux decreases. On the other hand, for the conduction phase angle being more than 90°, the DC voltage remains substantially unchanged and when stable lighting continues, the lamp voltage does not change, keeping the operating frequency constant and the luminous flux of the lamp unchanged. Thus, when the brightness is changed by utilizing a change in DC voltage in this manner, the brightness cannot be changed in conformity with the conduction phase angle. In such a case, it is desirable that the conduction phase angle be detected with a circuitry as shown in FIG. 26 to control the operating frequency. In FIG. 26, the preheating control circuit 100 sets a preheating period of the lamp electrodes as explained in connection with FIG. 7. As shown in FIG. 27, a conduction phase angle detection circuit 900 has an inductor 4*a* coupled inductively to the filtering inductor 4 of FIG. 14 and is operative to deliver a voltage conforming to a conduction phase angle to a voltage regulator circuit 950. The phase angle detection circuit 900 includes, in addition to the inductor 4*a*, elements 901 to 905. When the output voltage of the dimmer changes by Δvac as shown in FIGS. 28A, current flows, from the inductor 4*a*, through the diode 901 and inductor 903 to charge the capacitor 904 to thereby obtain DC voltage Vi. The inductor 903 is for prevention of overcurrent and is replaceable by a resistor. In another configuration for detection of the conduction phase angle, an additional inductor may be connected between the dimmer and the filter and the aforementioned inductor 4*a* may be coupled inductively. As will be seen from FIGS. 28A and 28B, with the conduction phase angle decreased, voltage change Δvac of the dimmer output voltage increases and as a result, the output voltage Vi increases. As described previously, the voltage regulator circuit 950 utilizes a field effect transistor as variable resistor and delivers a variable voltage to the shunt current adjuster circuit 600 in accordance with the voltage Vi. As shown in FIG. 27, the voltage regulator circuit 950 includes elements 951 to 954 and by changing gate voltage of the field effect transistor 954, output voltage at a node i-can be adjusted. The output voltage equals a level obtained by dividing Zener voltage of the Zener diode 952 by resistance 953 and an operating resistance of the transistor 954. Current is supplied from the node d of FIG. 14 to the Zener diode 952 through the resistor 951. The output voltage Vj is related to the gate control voltage Vi as shown in FIG. 29. In FIG. 29, when the transistor 954 is a MOS type n-channel field effect transistor, the operating resistance decreases with a high gate voltage Vi and so the output voltage Vj decreases. Accordingly, for a small conduction phase angle, the voltage Vi is high and the voltage Vj is low, causing the resistance Rko of the shunt current adjuster circuit 600 to decrease. Consequently, the inverter can be driven at the operating frequency fs sufficiently higher than the resonance frequency fr to reduce the lamp power.

Figure 30:
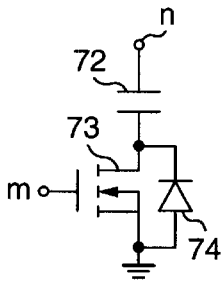
FIG. 30 is a circuit diagram showing another connection in the controller in the FIG. 14 embodiment.

In the foregoing, the operating frequency can be controlled by changing the inductance of the drive circuit but the operating frequency may be controlled by connecting a series connection of capacitor 72 and switching device 73 between the nodes n and o of FIG. 14 as shown in FIG. 30 and changing the resonance frequency by controlling a resultant capacitance of the resonance load circuit. The switching element 73 is, for example, a MOSFET and voltage at a control terminal m is controlled to control the conduction state of the MOSFET for the purpose of adjusting the capacitance between the nodes n and o.

Figure 31:
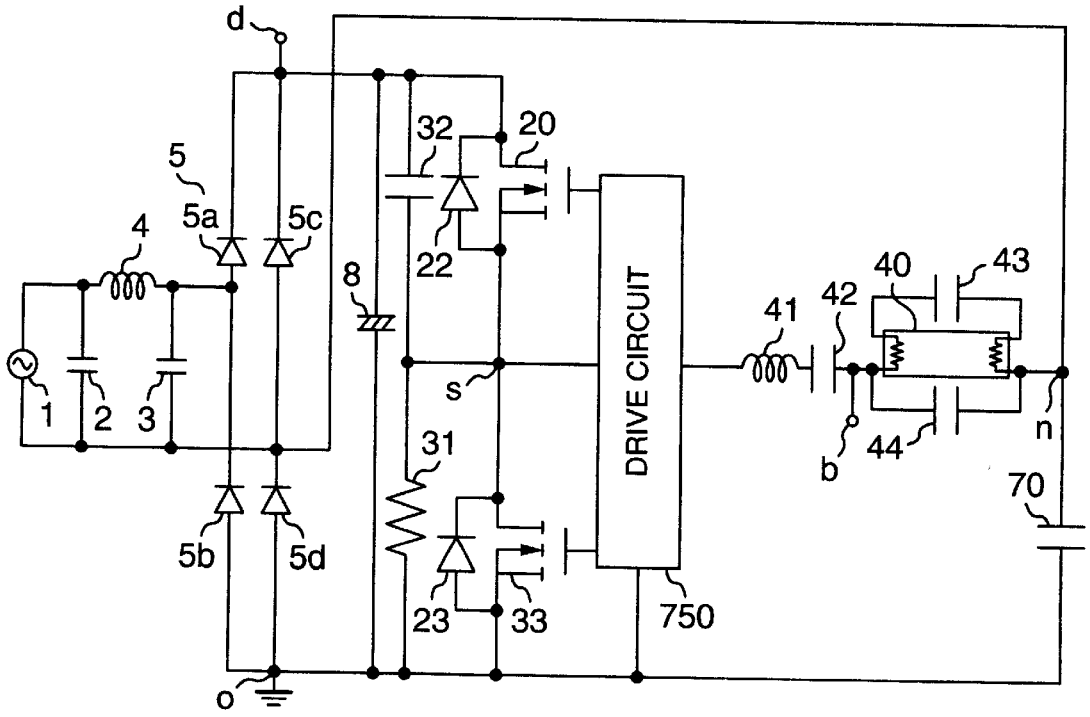
FIG. 31 is a circuit diagram of a lighting apparatus according to a fifth embodiment of the invention.
Figure 32:
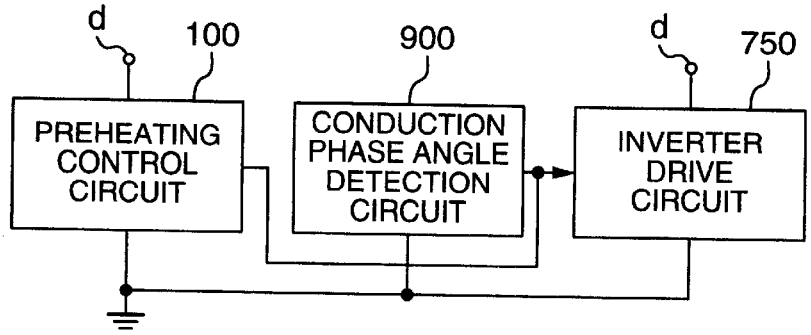
FIG. 32 is a block diagram showing the construction of a controller in the FIG. 31 embodiment.

In FIG. 14, the inverter drive circuit is of the self-excited type in which current of the resonance load circuit is fed back to generate the drive voltage but it may be of the separately-excited type. In a lighting circuit according to a fifth embodiment of the invention, a drive circuit 750 of the separately-excited type is used as shown in FIG. 31. In this case, the drive circuit 750 controls the operating frequency in accordance with outputs of the preheating control circuit 100 and conduction angle detection circuit 900 to adjust the lamp power as shown in FIG. 32. In an alternative, the operating frequency may be controlled in accordance with an input signal from the user, as described previously.

Thus, in the illumination lighting apparatus of the present invention, the electric power supplied to the lamp can be controlled with the simplified construction by detecting the state of the lamp, starting with the initiation of lighting, and consequently the luminous flux can be high immediately after lighting and at low temperatures and sufficient brightness can be obtained. Further, the input current can be passed during the total period of commercial AC power supply voltage, thereby ensuring that the electric power supplied to the lamp can be controlled using the dimmer for incandescent lamp.

As described above, according to the invention, the electric power supplied to the resonance load circuit is adjusted or regulated in accordance with the operating conditions of the discharge tube and therefore, the timer and the like can be unneeded for control operation during the initial lighting and the inexpensive apparatus of simplified construction can be provided.

What is claimed is:

1. An illumination lighting apparatus comprising:

a resonance load circuit including a discharge tube having a filament for illumination;

a power supply circuit for supplying a DC voltage;

an inverter for converting the DC voltage into an AC voltage and supplying the AC voltage to said resonance load circuit; and a control circuit for adjusting electric power supplied to said resonance load circuit in accordance with operation conditions of said discharge tube after initial lighting in which said discharge tube starts lighting following preheating, wherein said control circuit controls an output voltage supplied from said power supply circuit to said resonance load circuit to a higher level when the voltage or current of said filament is larger than a predetermined value, controls the output voltage of said power supply circuit such that the output voltage becomes lower during a preheating period for preheating said filament in preparation for lighting of said discharge tube set by a time constant circuit, than during lighting of said discharge tube.

2. An illumination lighting apparatus according to claim 1, wherein said control circuit detects the operating conditions of said discharge tube in terms of voltage of said discharge tube and controls the output voltage of said power supply circuit such that the output voltage of said power supply circuit becomes higher when the voltage of said discharge tube is higher than a predetermined level.

3. An illumination lighting apparatus according to claim 1, wherein said power supply circuit has a boosting function to increase the output voltage to said resonance load circuit.

4. An illumination lighting apparatus according to claim 3, wherein said inverter is driven by a voltage synchronous with a current flowing through said resonance load circuit.

5. An illumination lighting apparatus according to claim 4, wherein said power supply circuit is driven by a voltage synchronous with a current flowing through said resonance load circuit.

6. An illumination lighting apparatus according to claim 5, wherein:

said power supply circuit includes a rectifier circuit comprised of diodes to convert a commercial AC voltage into the DC voltage, a capacitor for smoothing the DC voltage, a filter circuit disposed between said rectifier circuit and the commercial AC voltage to filter the commercial AC voltage, an inductor for boosting the DC voltage and a switch device connected in series between positive and negative polarities of a pulsating voltage provided from said rectifier circuit, a diode connected between said inductor, said switch device and said smoothing capacitor, said resonance load circuit includes a capacitor for generating a voltage synchronous with the current of said resonance load circuit, and said switch device is driven by the voltage developing across said capacitor of said resonance load circuit.

7. An illumination lighting apparatus comprising:

a resonance load circuit including a discharge tube having a filament for illumination;

a power supply circuit for supplying a DC voltage;

an inverter for converting the DC voltage into an AC voltage and supplying the AC voltage to said resonance load circuit; and a control circuit for adjusting electric power supplied to said resonance load circuit in accordance with operation conditions of said discharge tube after initial lighting in which said discharge tube starts lighting following preheating, wherein said control circuit controls a driving frequency of said inverter to cause said inverter to decrease when the voltage or current of said filament is larger than a predetermined value, and controls the driving frequency of said inverter such that the driving frequency becomes higher during a preheating period of said filament set by a time constant circuit, than during lighting of said discharge tube.

8. An illumination lighting apparatus according to claim 7, wherein said inverter is driven by a voltage synchronous with the current flowing through said resonance load circuit.

9. An illumination lighting apparatus according to claim 8, wherein said inverter includes first and second switch devices connected in series between positive and negative polarities of the DC voltage supplied from said power supply circuit, said first and second switch devices corresponding N-channel and P-channel power semiconductor devices, respectively, a first capacitor for generating a voltage synchronous with the current flowing through said resonance load circuit connected between a common node between said first and second switch devices and a control terminal of said first and second switch devices, and a first inductor connected between said first capacitor and the control terminal of said first and second power semiconductor devices.

10. An illumination lighting apparatus according to claim 9, wherein said inverter includes a shunt current adjuster circuit having a second inductor coupled inductively to said first inductor and operative to control the current flowing bidirectionally through said second inductor.

11. An illumination lighting apparatus according to claim 10, wherein the current flowing through said shunt current adjuster circuit is controlled by a voltage adjuster circuit adapted to deliver a voltage conforming to the operating conditions of said discharge tube.

12. An illumination lighting apparatus according to claim 11, wherein said power supply circuit includes a rectifier circuit comprised of at least two diodes to convert a commercial AC voltage into the DC voltage, a capacitor for smoothing the DC voltage and a filter circuit connected between said rectifier circuit and the commercial AC voltage to filter the commercial AC voltage, and wherein said resonance load circuit includes first and second capacitors connected in series with an inductor for resonance, said first capacitor being connected in parallel with any one of the diodes of said rectifier circuit.

13. An illumination lighting apparatus comprising:

a resonance load circuit including a discharge tube;

a power supply circuit for supplying a DC voltage from a commercial AC voltage;

a voltage regulator adapted to adjust the commercial AC voltage supplied to said power supply circuit by using phase control;

an inverter for converting the DC voltage into an AC voltage and supplying the AC voltage to said resonance load circuit; and a control circuit for adjusting electric power supplied to said resonance load circuit in accordance with operating conditions of said discharge tube after initial lighting in which said discharge tube starts lighting following preheating, wherein the DC voltage supplied from said power supply circuit to said inverter is controlled through the phase control by said voltage regulator, wherein said power supply circuit has a boosting function to increase the DC voltage, wherein said power supply circuit includes a rectifier circuit comprised of diodes and a capacitor for smoothing the DC voltage, a filter circuit connected between said rectifier circuit and the commercial AC voltage, an inductor for boosting the DC voltage and a switch device connected in series between positive and negative polarities of a pulsating voltage provided from said rectifier circuit, a diode connected between said inductor, said switch device and said smoothing capacitor, wherein said resonance load circuit includes a capacitor so as to generate a voltage synchronous with the current flowing through said resonance load circuit, and wherein said switch device is driven by the voltage developing across said capacitor of said resonance load capacitor.

14. An illumination lighting apparatus according to claim 13, wherein said inverter is driven by a voltage synchronous with a current flowing through said resonance load circuit.

15. An illumination lighting apparatus comprising:

a resonance load circuit including a discharge tube;

a power supply circuit for generating a DC voltage from a commercial AC voltage;

a voltage regulator for regulating the commercial AC voltage supplied to said power supply circuit using phase control;

an inverter for converting the DC voltage into an AC voltage and supplying the AC voltage to said resonance load circuit; and a control circuit for adjusting electric power supplied to said resonance load circuit in accordance with operating conditions of said discharge tube after initial lighting in which said discharge tube starts lighting following preheating, wherein the DC voltage supplied from said power supply circuit to said inverter is controlled by said voltage regulator through the phase control, and wherein said discharge tube includes a filament having at least one electrode, and wherein said control circuit controls the output voltage of said power supply circuit such that said output voltage becomes lower during a preheating period of said filament set by a time constant circuit, than during lighting of said discharge tube.

16. An illumination lighting apparatus comprising:

a resonance load circuit including a discharge tube;

a power supply circuit for generating a DC voltage from a commercial AC voltage;

a voltage regulator adapted to perform phase control of the commercial AC voltage supplied to said power supply circuit;

an inverter for converting the DC voltage into an AC voltage and supplying the AC voltage to said resonance load circuit; and a control circuit for adjusting electric power supplied to said resonance load circuit in accordance with operating conditions of said discharge tube after initial lighting in which said discharge tube starts lighting following preheating, wherein said power supply circuit includes a rectifier circuit comprised of at least two diodes, a capacitor for smoothing and a filter circuit connected between said rectifier circuit and the commercial AC voltage, and wherein said resonance load circuit includes first and second capacitors connected in series with an inductor for resonance, and said first capacitor is connected in parallel to any one of the diodes of said rectifier circuit.

17. An illumination lighting apparatus according to claim 16, wherein a driving frequency of said inverter is controlled by the phase control of the commercial AC voltage based on said voltage regulator.

18. An illumination lighting apparatus according to claim 17, wherein said inverter is driven by a voltage synchronous with the current flowing through said resonance load circuit.

19. An illumination lighting apparatus according to claim 18, wherein said inverter includes first and second switch devices connected in series between positive and negative polarities of the DC voltage supplied from said power supply circuit, said first and second switch devices corresponding to N-channel power semiconductor device and P-channel power semiconductor device, respectively, a first capacitor for generating a voltage synchronous with a current flowing through said resonance load circuit connected between a common node between said first and second switch devices and a control terminal of said first and second switch devices, and a first inductor connected between said first capacitor and the control terminal of said first and second power semiconductor devices.

20. An illumination lighting apparatus according to claim 19, wherein said inverter includes a shunt current adjuster circuit having a second inductor coupled inductively to said first inductor and operative to control the current flowing bidirectionally through said second inductor.

21. An illumination lighting apparatus according to claim 20, wherein the current flowing through said shunt current adjuster circuit is controlled by said voltage regulator adapted to deliver a voltage responsive to a conduction phase angle of the commercial AC voltage.

22. An illumination lighting apparatus according to claim 16, wherein said discharge tube includes a filament having at least one electrode, and said control circuit controls a driving frequency of said inverter such that said driving frequency becomes higher during a preheating period of said filament than during lighting of said discharge tube.

23. An illumination lighting apparatus comprising:

a resonance load circuit including a discharge tube;

a power supply circuit for generating a DC voltage from a commercial AC voltage;

a voltage regulator for regulating the commercial AC voltage supplied to said power supply circuit using phase control;

an inverter for converting the DC voltage into an AC voltage and supplying the AC voltage to said resonance load circuit; and a control circuit for adjusting electric power supplied to said resonance load circuit in accordance with operating conditions of said discharge tube after initial lighting in which said discharge tube starts lighting following preheating, wherein the DC voltage supplied from said power supply circuit to said inverter is controlled by said voltage regulator through the phase control, and wherein a filter circuit is connected between said power supply circuit and the commercial AC voltage, said filter circuit including a first inductor, and a second inductor coupled inductively to said first inductor, a rectifier for rectifying the AC voltage developing across said second inductor and a smoothing circuit for smoothing the output of said rectifier, whereby the DC voltage is obtained in accordance with a conduction phase angle of the commercial AC voltage.

24. An illumination lighting apparatus comprising:

a resonance load circuit including a discharge tube;

a power supply circuit for generating a DC voltage from a commercial AC voltage;

a voltage regulator for regulating the commercial AC voltage supplied to said power supply circuit using phase control;

an inverter for converting the DC voltage into an AC voltage and supplying the AC voltage to said resonance load circuit; and a control circuit for adjusting electric power supplied to said resonance load circuit in accordance with operating conditions of said discharge tube after initial lighting in which said discharge tube starts lighting following preheating, wherein the DC voltage supplied from said power supply circuit to said inverter is controlled by said voltage regulator through the phase control, and wherein a filter circuit is connected between said power supply circuit and the commercial AC voltage, a first inductor is connected between said filter circuit and said commercial AC voltage, and a second inductor is coupled inductively to said first inductor, a rectifier is coupled for rectifying the AC voltage developing across said second inductor and a smoothing circuit is arranged for smoothing the output voltage of said rectifier, whereby the DC voltage is obtained in accordance with a conduction phase angle of the commercial AC voltage.

25. An illumination lighting apparatus according to claim 12, wherein said resonance load circuit includes capacity adjuster means for connecting a third capacitor in parallel with said first capacitor.

26. An illumination lighting apparatus according to claim 15, wherein said power supply circuit has a boosting function to increase the output voltage supplied to said resonance load circuit, and is driven by a voltage synchronous with a current flowing through said resonance load circuit.

27. An illumination lighting apparatus according to claim 23, wherein said power supply circuit has a boosting function to increase the output voltage supplied to said resonance load circuit, and is driven by a voltage synchronous with a current flowing through said resonance load circuit.

28. An illumination lighting apparatus according to claim 23, wherein said power supply circuit has a boosting function to increase the output voltage supplied to said resonance load circuit, and is driven by a voltage synchronous with a current flowing through said resonance load circuit.

* * * * *